US010531999B2

(12) United States Patent
Somjee

(10) Patent No.: US 10,531,999 B2
(45) Date of Patent: Jan. 14, 2020

(54) DEVICE FOR MASSAGING A USER

(71) Applicant: SRT PERFORMANCE PTY LTD, New South Wales (AU)

(72) Inventor: Ardhiat Somjee, Burnaby (CA)

(73) Assignee: SRT PERFORMANCE PTY LTD, Bronte (AU)

( * ) Notice: Subject to any disclaimer, the term of this patent is extended or adjusted under 35 U.S.C. 154(b) by 490 days.

(21) Appl. No.: 15/035,075

(22) PCT Filed: Nov. 7, 2014

(86) PCT No.: PCT/AU2014/050344

§ 371 (c)(1),
(2) Date: May 6, 2016

(87) PCT Pub. No.: WO2015/066772

PCT Pub. Date: May 14, 2015

(65) Prior Publication Data

US 2016/0279009 A1 Sep. 29, 2016

(30) Foreign Application Priority Data

Nov. 8, 2013 (AU) ..... 2013904331

(51) Int. Cl.

| | |
|---|---|
| ***A61H 1/00*** | (2006.01) |
| ***A61H 7/00*** | (2006.01) |
| ***A61H 15/00*** | (2006.01) |

(52) U.S. Cl.

CPC ..... *A61H 1/008* (2013.01); *A61H 7/007* (2013.01); *A61H 15/00* (2013.01); *A61H 2015/0014* (2013.01)

(58) Field of Classification Search

CPC .. A61H 1/008; A61H 7/007; A61H 2007/009; A61H 15/00; A61H 15/0092; A61H 2015/0014

See application file for complete search history.

(56) References Cited

U.S. PATENT DOCUMENTS

| | | | | |
|---|---|---|---|---|
| 2,446,099 | A * | 7/1948 | Niblack | A61H 15/0078 601/127 |
| 6,135,972 | A * | 10/2000 | Kuo | A61H 15/0092 601/119 |
| 8,142,376 | B2 * | 3/2012 | Gueret | A45D 34/041 601/122 |
| 2008/0255484 | A1 | 10/2008 | Gueret | |
| 2009/0112137 | A1 * | 4/2009 | Lamore | A63B 21/0004 601/112 |
| 2010/0049106 | A1 * | 2/2010 | Gueret | A45D 34/041 601/112 |
| 2011/0105286 | A1 | 5/2011 | Dye | |

(Continued)

OTHER PUBLICATIONS

International Search Report and Written Opinion prepared by the Australian Patent Office dated Jan. 30, 2015, for International Application No. PCT/AU2014/050344.

*Primary Examiner* — Valerie L Woodward
(74) *Attorney, Agent, or Firm* — Berg Hill Greenleaf Ruscitti LLP.

(57) ABSTRACT

A device for massaging a user having an elongate body and one or more ribs extending therefrom, the one or more ribs forming an undulation, whereby urging the one or more ribs against a body of the user and rolling the elongate body there along massages the user.

7 Claims, 14 Drawing Sheets

(56) References Cited

U.S. PATENT DOCUMENTS

| | | | | |
|---|---|---|---|---|
| 2012/0035029 | A1* | 2/2012 | Dye | A61H 15/0092<br>482/132 |
| 2012/0310125 | A1* | 12/2012 | Hall | A61H 15/0085<br>601/120 |
| 2013/0096472 | A1* | 4/2013 | Bertram | A61H 15/0092<br>601/120 |
| 2013/0184620 | A1* | 7/2013 | Cohen | A61H 15/0092<br>601/118 |
| 2013/0261517 | A1* | 10/2013 | Rodgers | A61H 7/00<br>601/121 |
| 2014/0371784 | A1* | 12/2014 | Kwak | A61H 39/04<br>606/204 |

* cited by examiner

DEVICE FOR MASSAGING A USER

CROSS REFERENCE TO RELATED APPLICATIONS

This application is a national stage application under 35 U.S.C. 371 and claims the benefit of PCT Application No. PCT/AU2014/050344 having an international filing date of Nov. 7, 2014, which designated the United States, which PCT application claimed the benefit of Australian Patent Application No. 2013904331 filed Nov. 8, 2013, the disclosures of each of which are incorporated herein by reference.

TECHNICAL FIELD

The present invention relates generally to devices used for performing massage therapy and in particular, relates to a device adapted to manipulate soft tissue to provide a specific massage action.

BACKGROUND TO THE INVENTION

During sports or other recreational activities, it is common for persons to suffer muscular trauma, i.e. mechanical stress on muscle protein tissue, to both skeletal muscle and surrounding fascia. Such trauma can cause a to disruption of skeletal muscle plasticity and can also impede the flow of nutrients, metabolites and blood through a muscle. In instances where fascia does not heal correctly, it can form 'fibrotic adhesions', also known as 'trigger points', which are regions where different layers of fascia adhere together, causing tissue occlusion. Tissue occlusion can contribute towards a wide range of musculoskeletal issues, including pain, unnecessary tone, restriction of blood flow, reduced tissue elasticity and decreased joint movement.

In the past, these issues have primarily been treated by remedial massage therapists practising certain techniques, such as 'trigger point release' (also known as 'myofacial release') or acupressure manual therapy. The physiological principle of such techniques is to manually affect skeletal tissue and receptors by releasing fibrotic adhesions and excessive tone within the effected tissue.

As an alternative to engaging a skilled practitioner to treat these problems, it has become increasingly popular for affected persons to use a 'self-myofacial release' (SMR) product. In recent years, SMR and trigger point release products have been widely accepted as a technique to restore tissue health amongst professional, amateur and recreational athletes, and persons in rehabilitation. A number of different SMR devices exist, the most popular being variants of a 'foam roller', which comprise a rigid tube surrounded by a layer of foam which typically forms a grid of protrusions. The roller is 'rolled' along a portion of a user's body whilst a force is exerted on the roller perpendicular to the direction of roll. The foam protrusions compress the portion of the body which the device is rolled along, thereby improving myofacial release and blood flow in that portion.

Whilst these conventional foam roller devices may provide some therapeutic assistance, they often lack effectiveness and do not optimise soft tissue separation and/or improve blood flow to adhered and occluded areas. Also, many known SMR foam roller devices are not durable as the foam layer becomes permanently compressed over time, rendering the device useless.

Accordingly, it would be useful to provide a solution that avoids or ameliorates any of the disadvantages present in the prior art, or which provides another alternative to the prior art approaches.

SUMMARY OF THE INVENTION

According to one aspect of the invention there is provided a device for massaging a user, the device comprising an elongate body defining a longitudinal axis and one or more ribs extending radially from the elongate body, the one or more ribs forming an undulation, whereby urging the one or more ribs against a body of a user and rolling the elongate body about the longitudinal axis therealong massages the user.

BRIEF DESCRIPTION OF THE DRAWINGS

Preferred embodiments of the invention will now be described, by way of example only, with reference to the accompanying drawings in which.

DETAILED DESCRIPTION OF PREFERRED EMBODIMENTS

The present disclosure generally relates to a device used to treat a user with massage therapy. In particular, the invention relates to a device for massaging a user, the device comprising an elongate body defining a longitudinal axis and one or more ribs extending radially from the elongate body, the one or more ribs forming an undulation. In use, urging the one or more ribs against a body of a user and rolling the elongate body about the longitudinal axis therealong massages the user.

Figure 1:
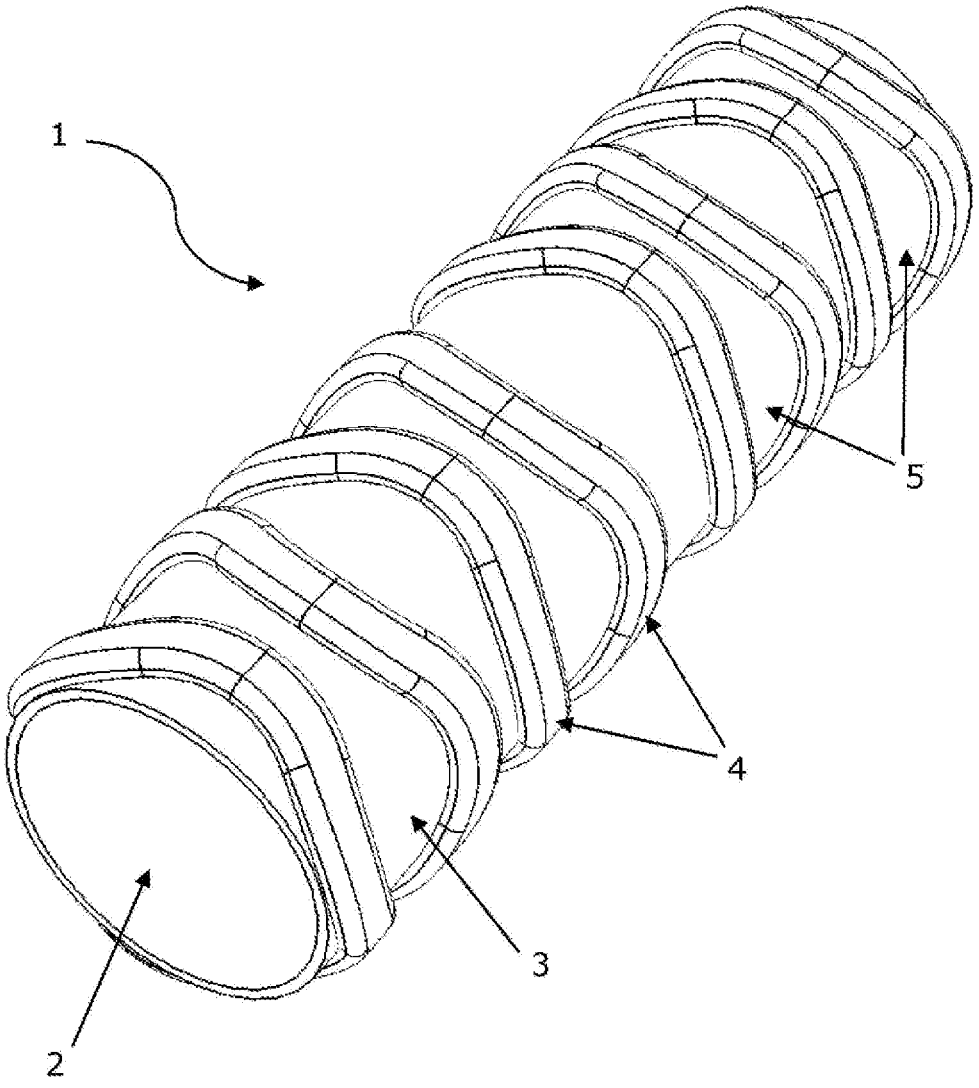
FIG. 1 is a perspective view of a massage device.
Figure 2:
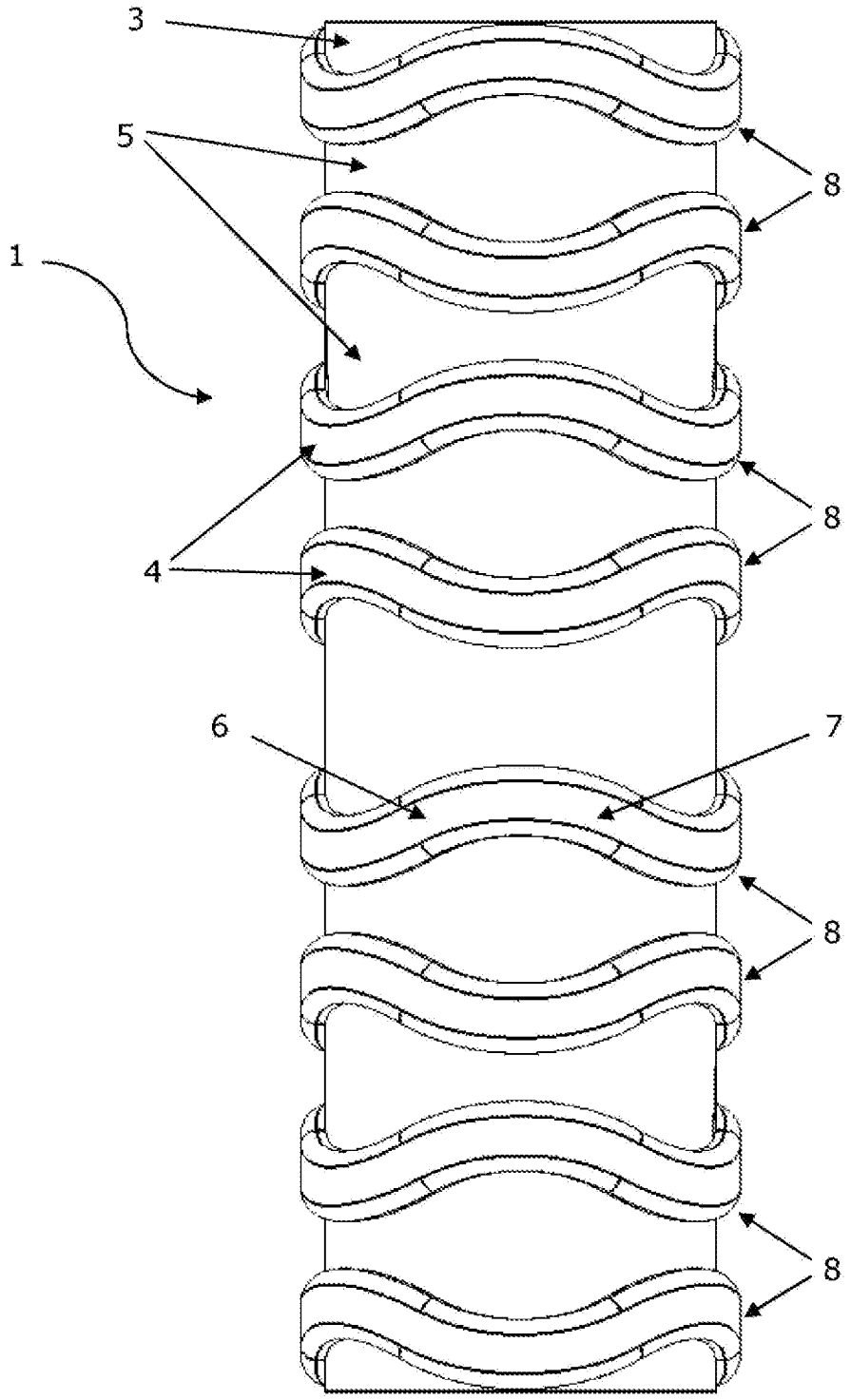
FIG. 2 is a front view of the device shown in FIG. 1.
Figure 3:
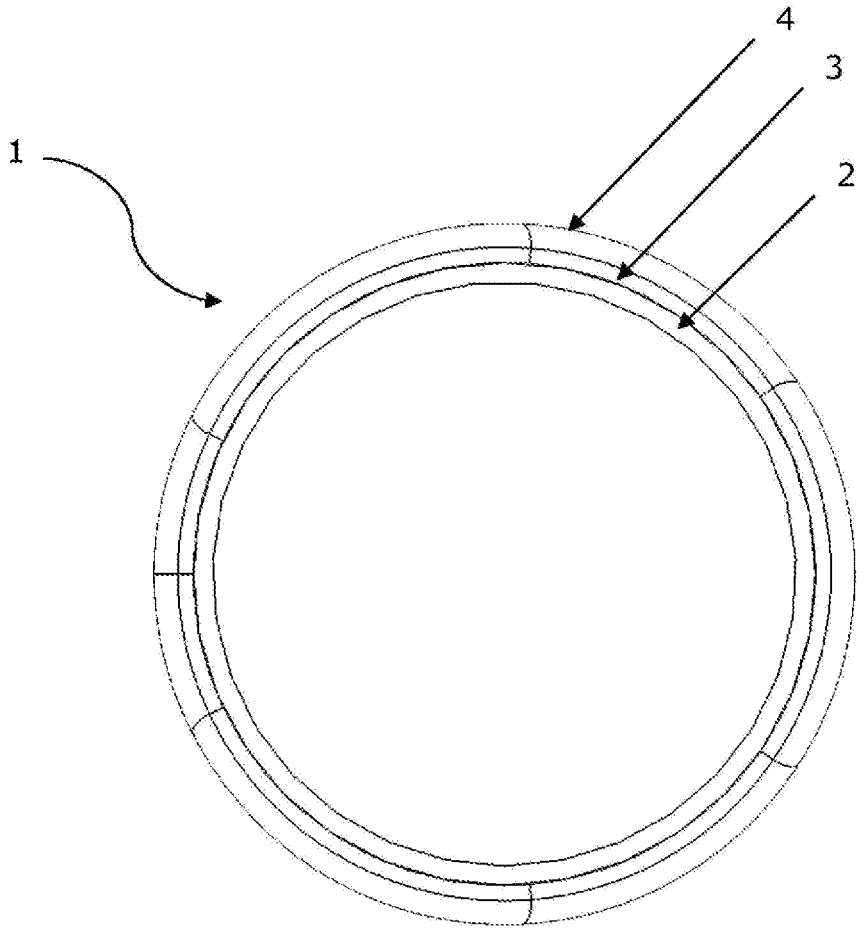
FIG. 3 is a top view of the device shown in FIGS. 1 and 2.

FIGS. 1 to 3 show a massage device 1 having an elongate body 2 defining a longitudinal axis, and a plurality of ribs 4 extending radially therefrom. The ribs 4 are integrally formed with a sleeve 3 affixed to and surrounding the elongate body 2. The elongate body is formed from a rigid material and the sleeve 3 is formed from a resiliently deformable material. Alternatively, the ribs 4 may be formed integrally with the elongate body 2 and from a different material to the body 2. For example, the elongate body 2 may be formed from a rigid plastic, such as ABS, and the ribs 4 formed from a resiliently deformable material, such as a silicone compound or synthetic rubber.

Each rib 4 forms a plurality of undulations extending around a peripheral region of the elongate body. Each undulation is arranged perpendicular to the longitudinal axis and forms a continuous loop. The undulations are also substantially parallel to, and spaced part from, each other. Whilst each rib 4 forms a loop of multiple undulations, it will be appreciated that the loop may be formed from a plurality of discrete undulations, each undulation formed from a separate rib (not shown). Similarly, each undulation may be formed from a plurality of discrete ribs (not shown) spaced apart from each other, the undulation thereby having a dashed appearance.

Adjacent ribs 4 form channels 5 therebetween. When the device 1 is urged against and rolled along the user's body, the ribs 4 exert force on soft tissue of the body and adjacent channels 5 provide a cavity into which the soft tissue deforms. This provides a massage action through moving the soft tissue in different directions, which is known to release fascia adhesions, increase blood and lymph flow in the massaged area and assist the massaged area to recover from injury.

During use, the arrangement of the ribs 4 in undulations pushes soft tissue in different directions. For example, as ribs 4 are arranged as continuously curving, wave-like undulations, this pushes soft tissue in a complimentary, side-to-side motion as the device is rolled along the body of the user. Moving soft tissue in this way promotes fascia fibre separation which releases facia adhesions and also pulls muscle tissue away from a connected bone.

The ribs 4 form symmetrical undulations comprising two oppose curves. Alternatively, the ribs 4 may form non-symmetrical undulations, or undulations comprising straight lines, dependent on the massage therapy the device 1 is configured to provide.

The ribs 4 are arranged in pairs 8, each pair 8 spaced apart from an adjacent pair 8. The undulations of each rib 4 are arranged out of phase to an adjacent rib 4, to cause a spreading and pinching motion on soft tissue as the device 1 is rolled therealong. The undulations form a series of peaks and troughs, and the peaks of a first undulation are arranged adjacent to the trough of an adjacent undulation.

The distance between pairs 8 of ribs 4 is varied along the length of the elongate body 2 so that different portions of the device 1 provide a different massage effect. For example, the central pairs 8 are spaced further apart than other pairs 8, to provide a wider channel 5 and decrease the force exerted on soft tissue that deforms within this channel during use of the device. Conversely, the pairs 8 at each end of the device 1 are spaced closer together to increase the force exerted on soft tissue that is urged between these pairs 8 during use.

Referring to FIG. 3, the depth of the ribs 4 is visible, whereby each rib 4 has substantially identical depth dimension. The depth dimension of the ribs 4 may be varied according to the desired massage action, where generally deeper ribs 4 exert more force on the user and provide a more vigorous massage action. The depth of the ribs 4 may also be varied along each rib 4, to form deeper and shallower portions, to vary force exerted on the user as the device 1 is rolled along the body.

Figure 4A:
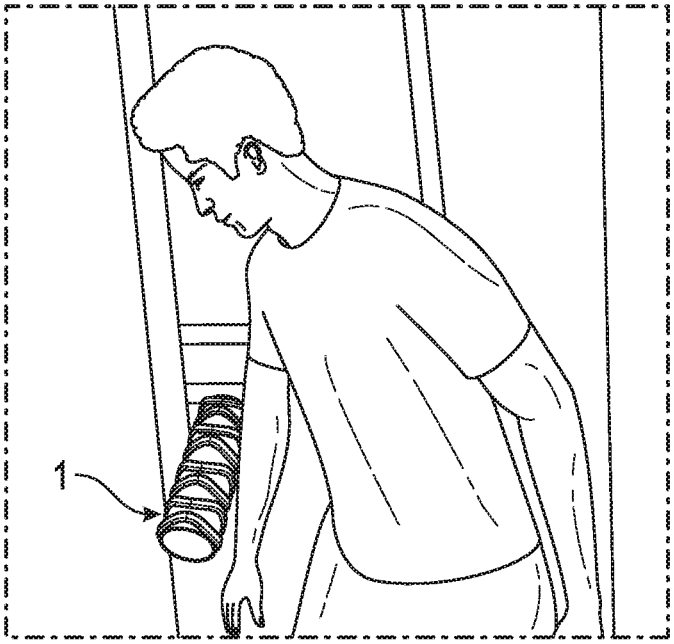
FIGS. 4A and 4B are perspective views of a user massaging a limb with the device shown in FIGS. 1 to 3.

FIGS. 4A and 48 show the device 1 being used to perform a 'self myofacial release' (SMR) treatment. In general, when performing SMR treatment, the user positions the device 1 on a surface and simultaneously urges and rolls the device 1 along a limb, thereby urging the ribs 4 into the soft tissue of the limb.

Figure 4B:
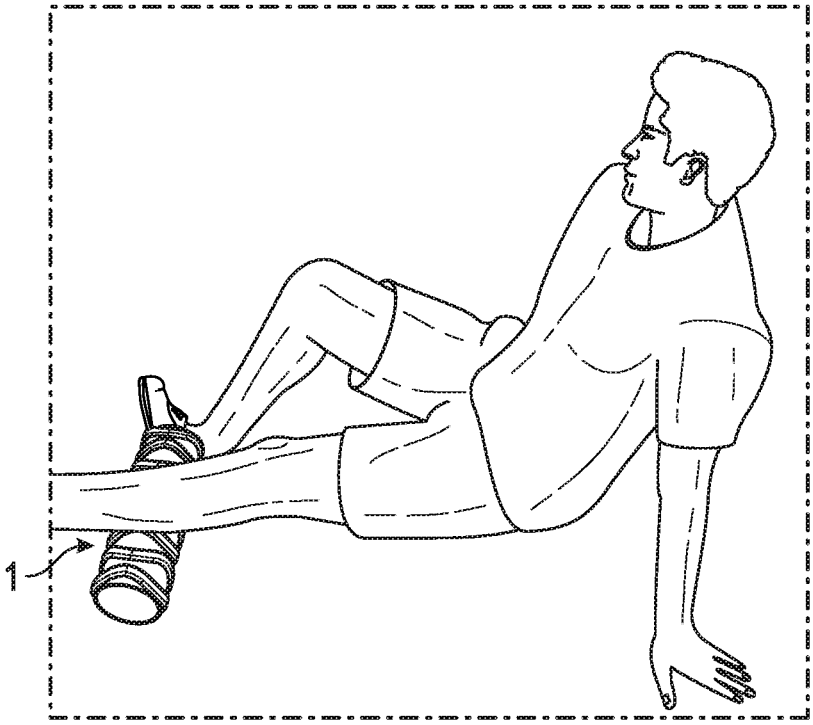

FIG. 4A shows the user trapping the device 1 between an arm and a wall and simultaneously urging the arm against the device 1 and rolling the device across the wall, to massage the arm. FIG. 4B shows the user trapping the device 1 between a leg and a floor and simultaneously urging the leg against the device 1 and rolling the device across the floor, to massage the leg.

Figure 5:
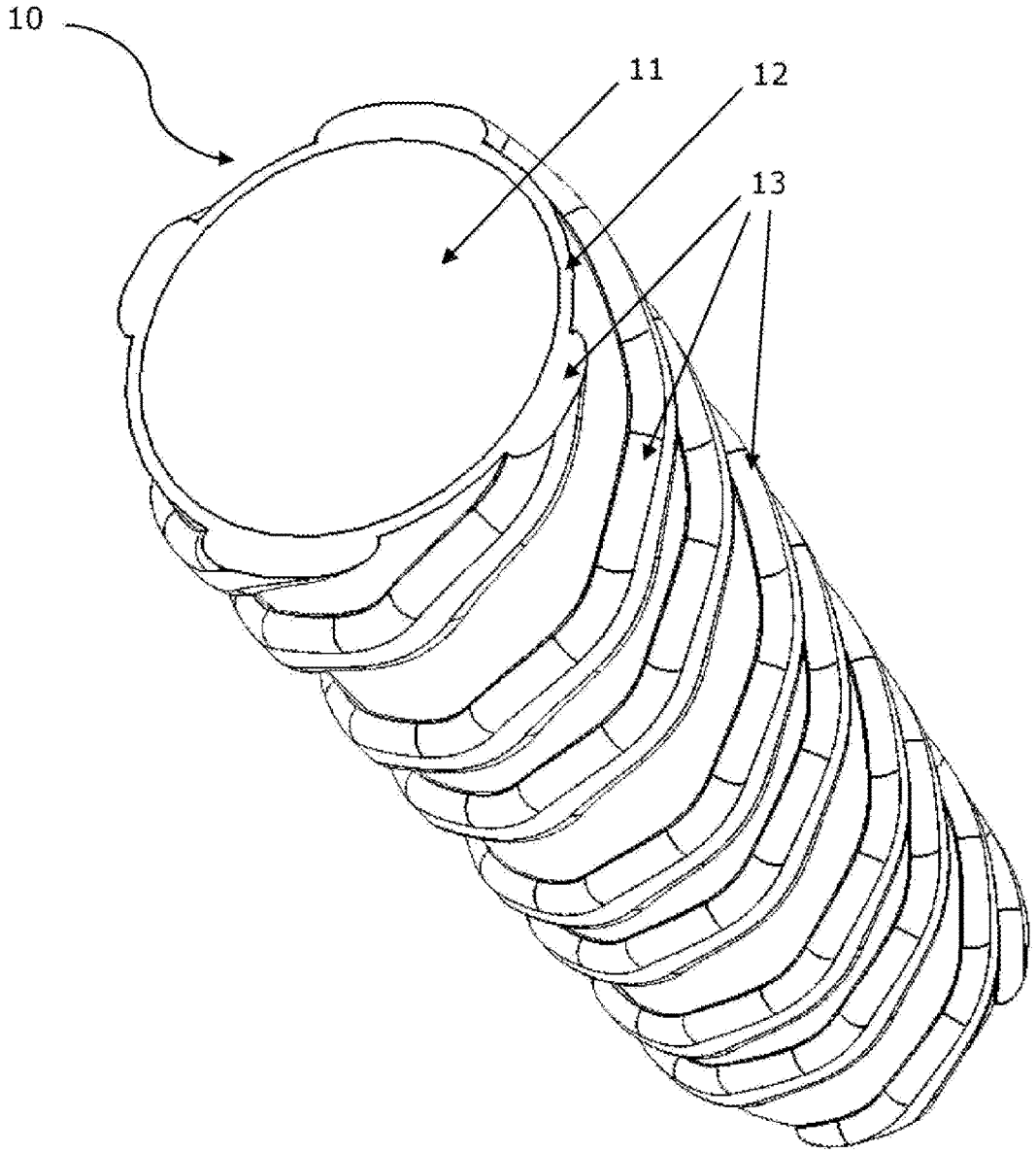
FIG. 5 is a perspective view of an alternative massage device.
Figure 6:
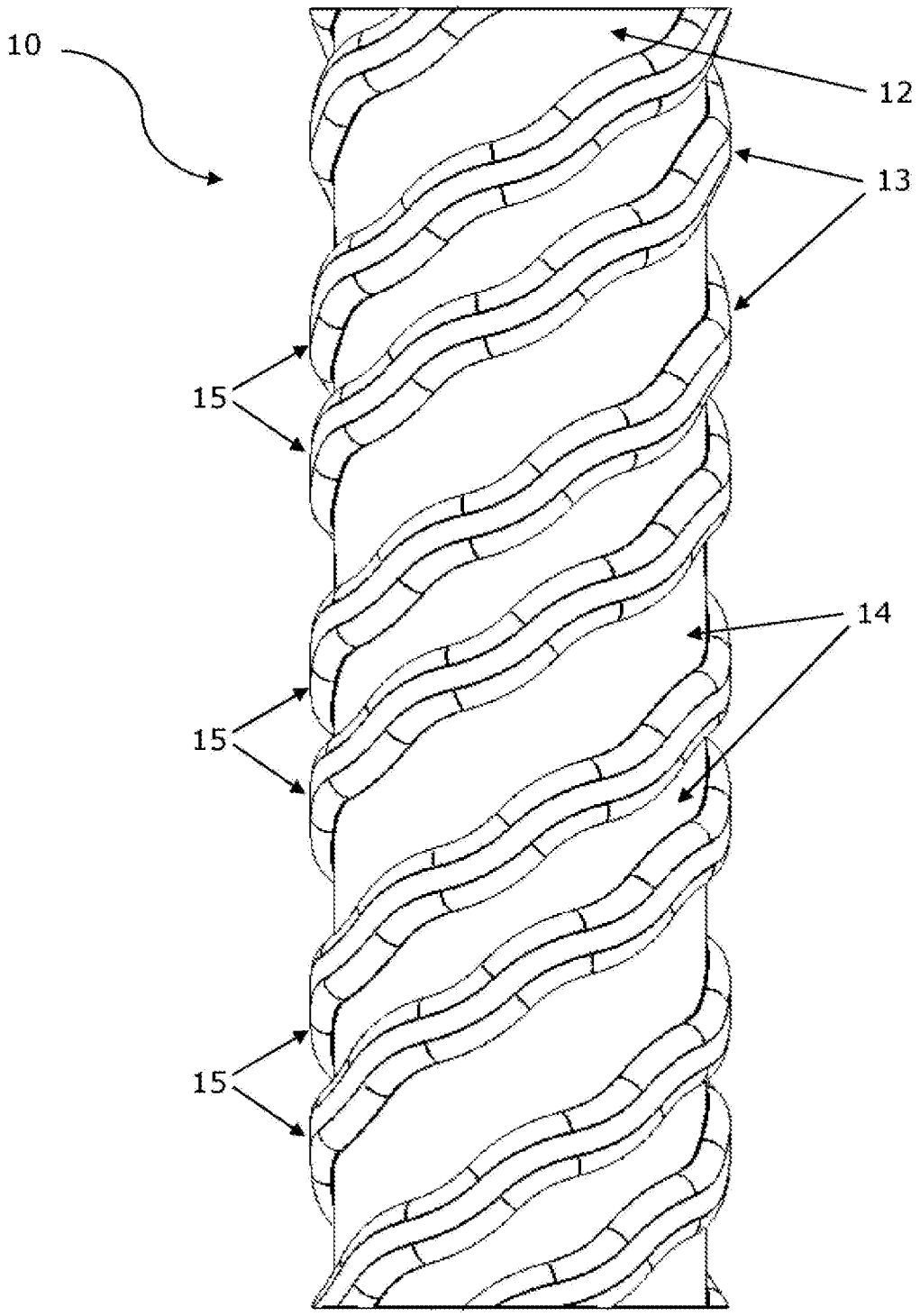
FIG. 6 is a front view of the device shown in FIG. 5.
Figure 7:
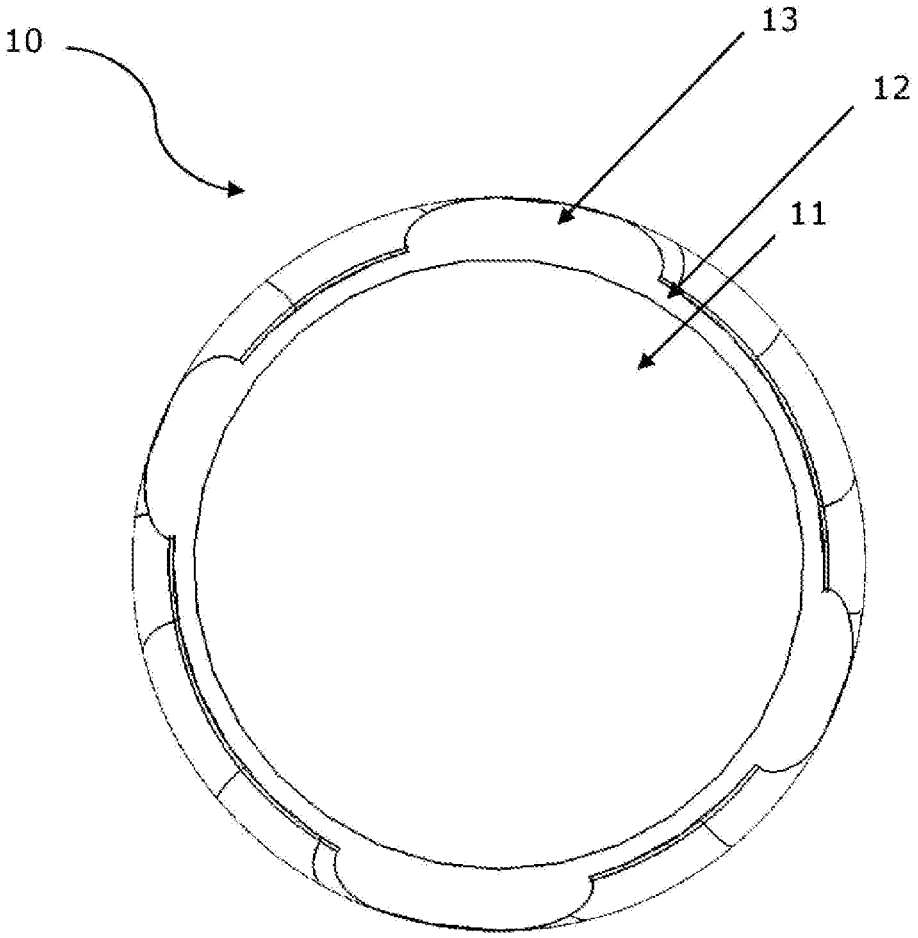
FIG. 7 is a top view of the device shown in FIGS. 5 and 6.

FIGS. 5 to 7 show an alternative massage device 10 having an elongate body 11 and a plurality of ribs 13 extending therefrom, Each rib 13 forms a plurality of undulations arranged on a helix arranged along the length of the elongate body 11. The ribs 13 are arranged in pairs 15, where the undulations of the ribs 13 in each pair 15 are arranged out of phase with one another.

Figure 8:
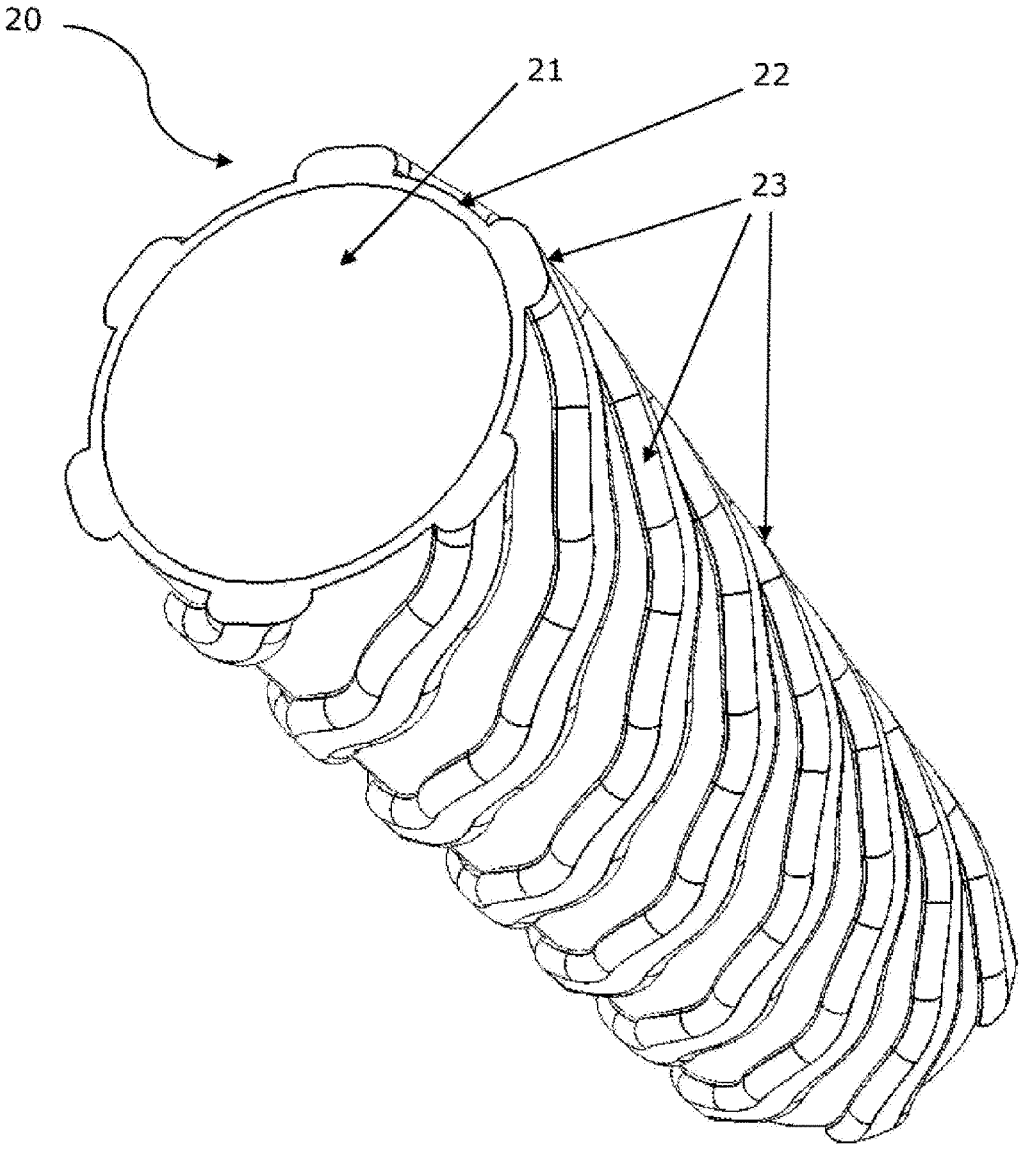
FIG. 8 is a perspective view of a further alternative massage device.
Figure 9:
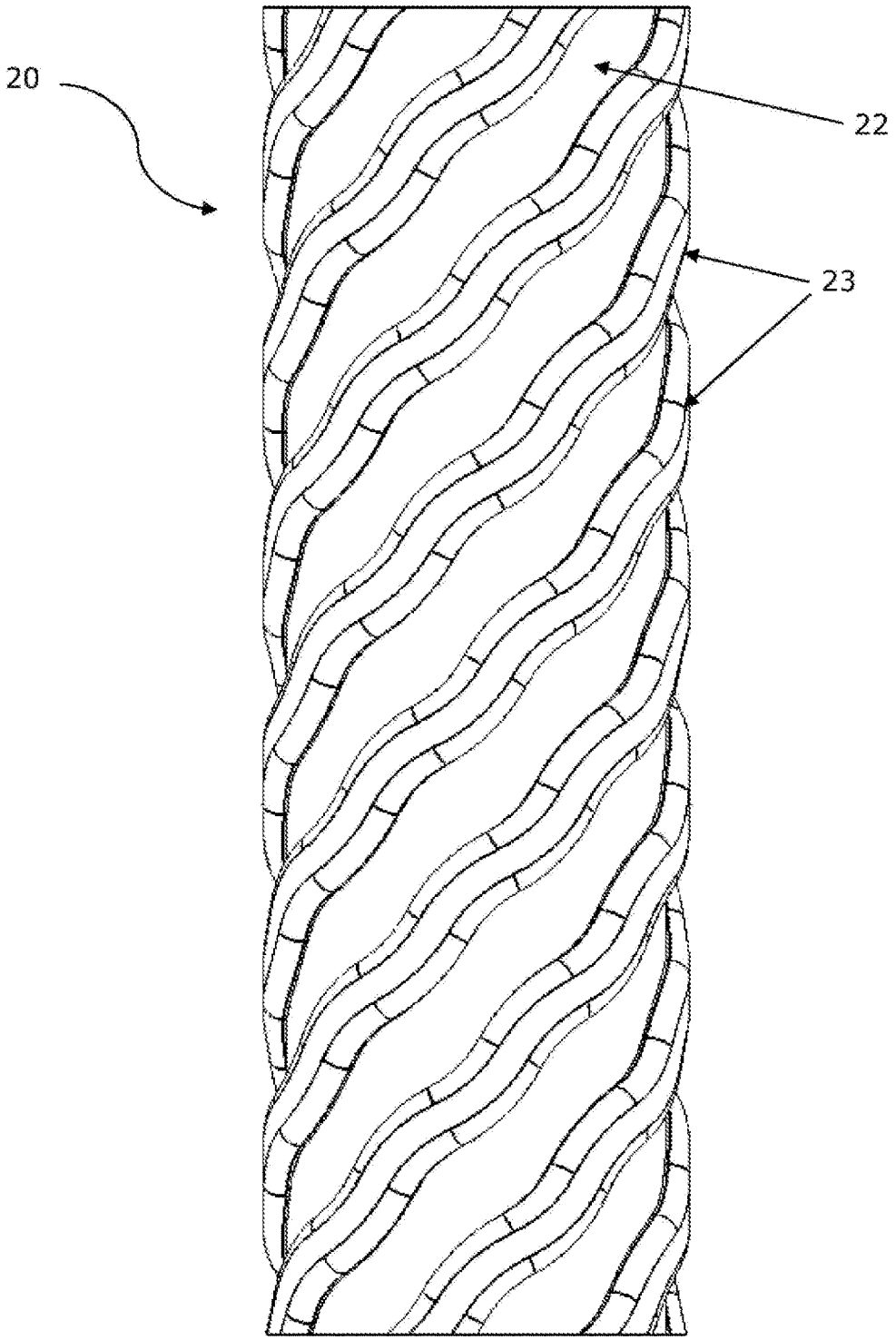
FIG. 9 is a front view of the device shown FIG. 8.
Figure 10:
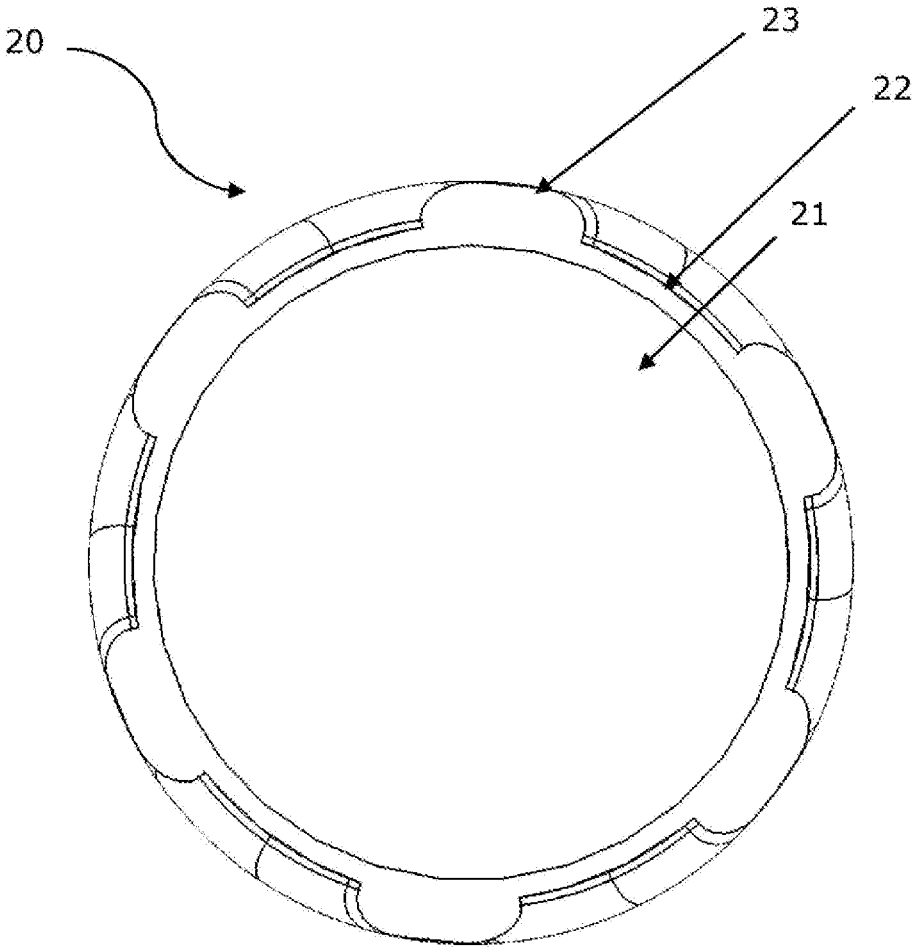
FIG. 10 is a top view of the device shown in FIGS. 8 and 9.

FIGS. 8 to 10 show a further alternative massage device 20 having an elongate body 21 and a plurality of ribs 23 extending therefrom. The ribs 23 are not arranged in pairs and instead, are arranged substantially in phase with each other, thereby providing a different massage action.

Figure 11B:
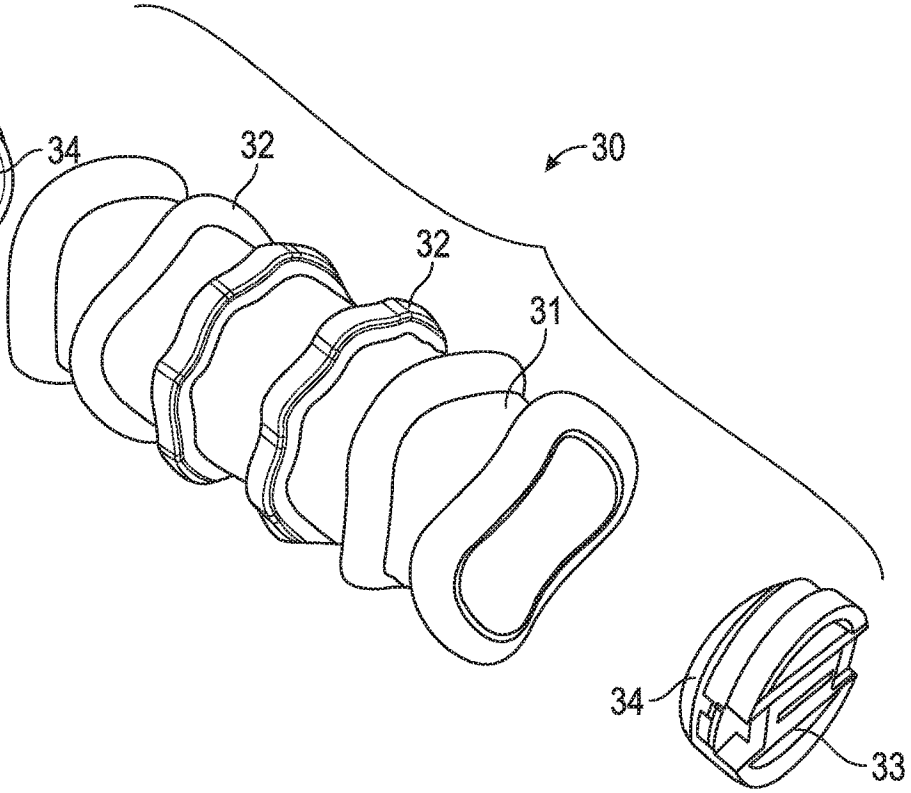
FIGS. 11A and 11B are perspective views of a further alternative massage device.
Figure 11A:
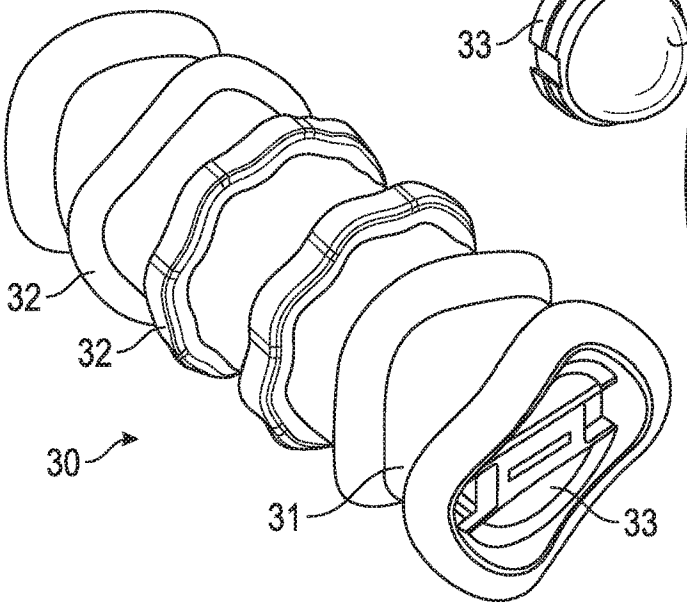

FIGS. 11A and 11B show exploded and non-exploded views of a further alternative massage device 30 having an elongate body 31 and a plurality of ribs 32 extending therefrom. Each rib 32 forms a plurality of undulations arranged around a peripheral region of the elongate body 31 to form a continuous loop. A handle 33 is removably connected to ends of the device 30. Optionally, each handle 33 is rotatably connectable, thereby allowing the user to grip the handle and roll the device 30 along the body. Each handle 33 includes a domed portion 34. The domed portion 34 may also be urged against the user's body to provide an alternative massage action in specific areas.

Figure 12:
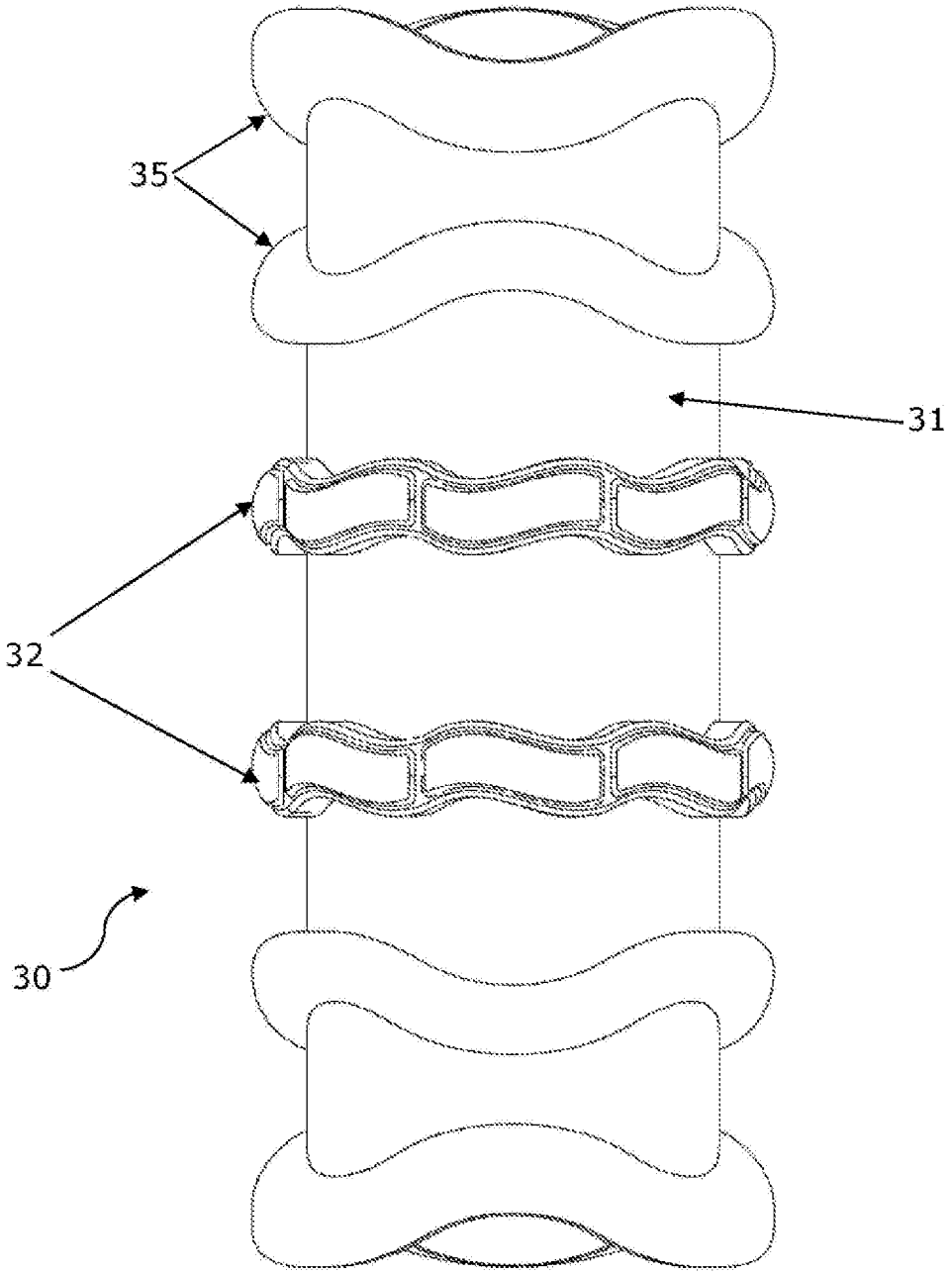
FIG. 12 is a front view of the device shown in FIG. 11.

FIG. 12 shows a front view of the device 30 shown in FIG. 11. At least some of the ribs 32 form an inclined surface 35 relative to the elongate body 31, in order to further manipulate soft tissue during use. The two ribs 32 closest to either end of the elongate body 31 have opposed inclined surfaces 35.

Figure 13:
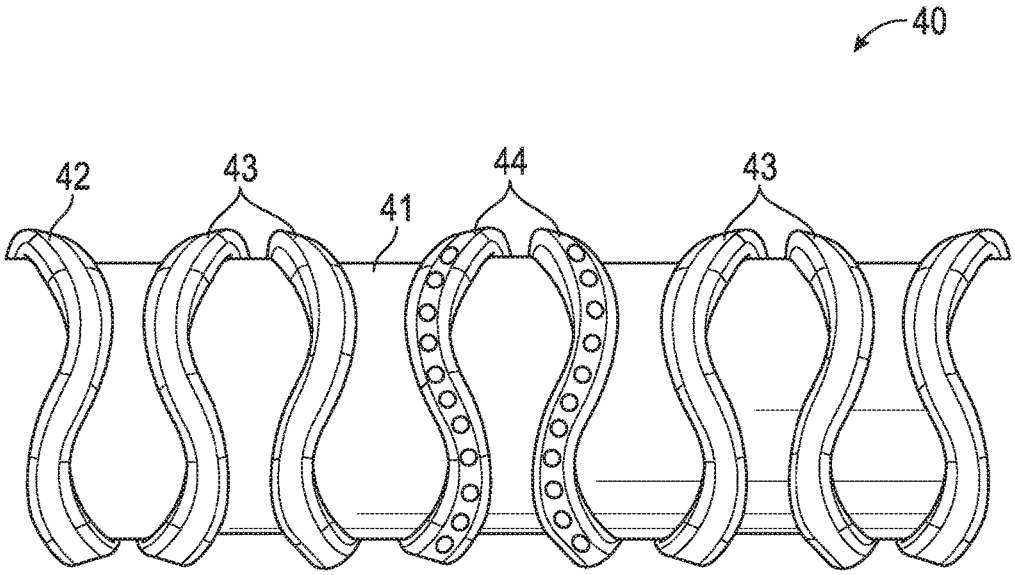
FIG. 13 is a front view of a further alternative massage device.

FIG. 13 shows a front view of another massage device 40 having an elongate body 41 and a plurality of ribs 42 extending therefrom. Each rib 42 forms a plurality of undulations arranged around a peripheral region of the elongate body 41 to form a continuous loop. Each rib 42 also forms a top surface 43 arranged to contact a user during use, the top surface arranged at an angle relative to the elongate body 41. Some of the ribs 42 have a top surface 43 arranged at an acute angle relative to the elongate body 41, and some ribs 42 have a top surface 43 arranged at an obtuse angle relative to the elongate body 41. The two central ribs 42 have a plurality of protrusions, being hemispherical domes, 44 extending therefrom to provide an additional massage action during use.

Figure 14:
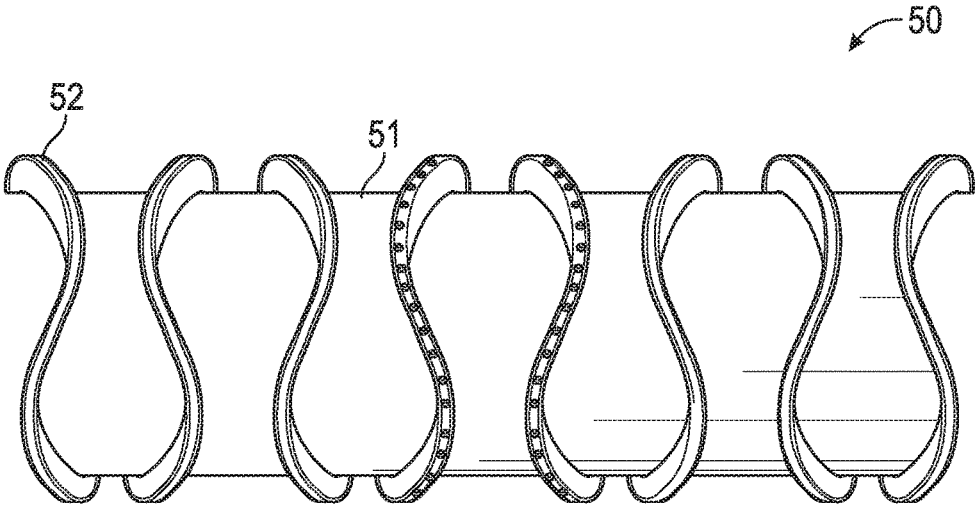
FIG. 14 is a front view of a further alternative massage device.

FIG. 14 is a front view of a further alternative massage device 50, having an elongate body 51 and a plurality of ribs 52 extending therefrom. Each rib 52 forms a plurality of undulations arranged around a peripheral region of the elongate body 51 to form a continuous loop. The ribs 52 are substantially narrower and deeper than the ribs 42 of the device 40 shown in FIG. 13. This arrangement means that, for comparative usage forces, the device 50 exerts greater pressure on the soft tissue of the user, providing a more rigorous massage action.

Figure 15:
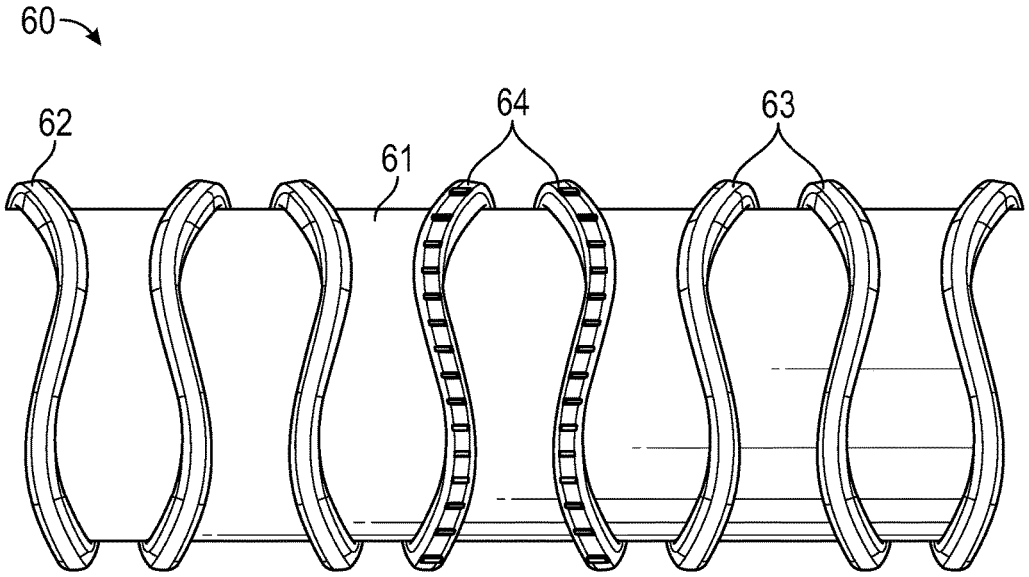
FIG. 15 is a front view of a further alternative massage device.

FIG. 15 shows a front view of another massage device 60 having an elongate body 61 and a plurality of ribs 62 extending therefrom. Each rib 62 forms a plurality of undulations arranged around a peripheral region of the elongate body 51 to form a continuous loop. Each rib has a top surface 63, at least some of the top surface 63 arranged at an acute or obtuse angle relative to the elongate body 61. The two central ribs 62 also have a plurality of sub-ribs 64 extending therefrom and arranged substantially parallel to the longitudinal axis of the elongate body 61, to provide an additional massage action during use. In an alternative embodiment (not shown), the two central ribs 62 are absent and replaced with the sub-ribs 64. The undulations arranged around the central portion of the device 60 are thereby formed from the plurality of sub-ribs 64.

It will be apparent that obvious variations or modifications may be made to the present invention which are in accordance with the spirit of the invention and which are intended to be part of the invention. Although the invention is described above with reference to specific embodiments, it will be appreciated that it is not limited to those embodiments and may be embodied in other forms.

What is claimed is:

1. A device for massaging a user, the device comprising:

an elongate body defining a longitudinal axis; and one or more pair of ribs extending radially from the elongate body, each rib of said one or more pair of ribs forming a plurality of undulations extending around a peripheral region of the elongate body; each undulation being arranged perpendicular to the longitudinal axis and forming a continuous loop around the elongate body, wherein the one or more pair of ribs form an inclined surface relative to the elongate body;

wherein one or more first ribs of said one or more pair of ribs form a first undulation, and one or more second ribs of said one or more pair of ribs form a second undulation, wherein the first and second undulations are parallel and spaced apart from each other and wherein the first undulation is arranged out of phase with the second undulation, to cause a spreading and pinching motion on soft tissue as the device is rolled along the body of the user; and each rib of said one or more pair of ribs forms a top surface arranged to contact a user during use; wherein the first undulation has a top surface arranged at an obtuse angle relative to the elongate body, in order to further manipulate soft tissue during use;

wherein the device further comprises two central ribs having a plurality of sub-ribs extending therefrom and arranged parallel to the longitudinal axis of the elongate body to provide an additional massage action during use, whereby urging the one or more pair of ribs against a body of the user and rolling the elongate body about the longitudinal axis therealong massages the user.

2. The device according to claim 1, wherein the continuous loop is arranged perpendicular to the longitudinal axis.

3. The device according to claim 1, wherein each of the first undulation and the second undulation has a peak and a trough, and wherein the peak of the first undulation is adjacent to the trough of the second undulation.

4. The device according to claim 1, wherein the one or more pair of ribs form a surface having a plurality of protrusions extending therefrom.

5. The device according to claim 1, wherein each undulation comprises two opposed curves.

6. The device according to claim 1, wherein each rib of said pair or ribs is resiliently deformable.

7. The device according to claim 1 further comprising at least one handle connected to an end of the device; wherein the at least one handle is rotatably or releasably connected to the device and wherein the at least one handle further comprises a domed portion.

* * * * *